US006572261B1

(12) United States Patent
Angerhofer et al.

(10) Patent No.: US 6,572,261 B1
(45) Date of Patent: Jun. 3, 2003

(54) HORIZONTAL AGITATOR

(75) Inventors: Richard L. Angerhofer, Tomah, WI (US); Robert J. Anderson, Wilton, WI (US); Randall S. Anderson, Elroy, WI (US)

(73) Assignee: Walker Stainless Equipment Company, New Lisbon, WI (US)

( * ) Notice: Subject to any disclaimer, the term of this patent is extended or adjusted under 35 U.S.C. 154(b) by 28 days.

(21) Appl. No.: 09/879,534

(22) Filed: Jun. 12, 2001

(51) Int. Cl.[7] ..... B01F 7/02
(52) U.S. Cl. ..... 366/331; 366/608
(58) Field of Search ..... 366/331, 169.1, 366/169.2, 608, 286, 289, 332; 277/408, 407, 512, 301, 379–382

(56) References Cited

U.S. PATENT DOCUMENTS

| | | | | | |
|---|---|---|---|---|---|
| 1,307,595 | A | | 6/1919 | Nielsen | |
| 1,808,353 | A | * | 6/1931 | Jackson | 366/601 |
| 2,096,597 | A | | 10/1937 | Seabrooks | |
| 2,347,195 | A | * | 4/1944 | Huff | 366/169.2 |
| 3,297,309 | A | | 1/1967 | Adams | |
| 3,887,169 | A | | 6/1975 | Maynard | |
| 4,130,287 | A | * | 12/1978 | Ritzie | 277/408 |
| 4,136,886 | A | * | 1/1979 | Sjoholm et al. | 277/408 |
| 4,511,255 | A | * | 4/1985 | Saucier | 366/286 |
| 5,108,715 | A | | 4/1992 | Jekat et al. | 422/159 |
| 5,171,023 | A | * | 12/1992 | Scott et al. | 277/408 |
| 5,427,450 | A | * | 6/1995 | Gambrill | 366/168.1 |
| 5,885,000 | A | | 3/1999 | Miyahara et al. | 366/251 |
| 6,193,409 | B1 | * | 2/2001 | Brunson et al. | 366/331 |

OTHER PUBLICATIONS

Paul Mueller Company—patent–pending, USDA 3–A accepted, horizontal agitator Web–site: http://www.muel-.com/products/processing/foodanddairy/siloHorizontalAgitation.cfm.cfm.

* cited by examiner

*Primary Examiner*—Tony G. Soohoo
(74) *Attorney, Agent, or Firm*—Rader, Fishman & Grauer PLLC

(57) ABSTRACT

An agitator assembly for mounting in a wall of a storage tank that includes a body having a rotatable shaft extending therethrough. The body includes a duct having a diameter that is larger than the diameter of the shaft to allow passage of a fluid therebetween. An impeller is secured to one end of the shaft and a collar is secured to the other end. A bushing is provided between the body and the shaft and allows passage of a fluid during a cleaning cycle. A motor assembly is attached to the shaft and provides power for rotation of the shaft. A resilient member is provided over the shaft between the motor assembly and collar to control axial movement of the shaft. During a cleaning cycle, fluid pressure overcomes the biasing force of the compressible member permitting the fluid to escape the body to effectively clean the impeller.

23 Claims, 3 Drawing Sheets

HORIZONTAL AGITATOR

FIELD OF THE INVENTION

The present invention relates generally to an agitator apparatus, and more particularly to a horizontal agitator suitable for use in the food, dairy and beverage industries.

BACKGROUND OF THE INVENTION

In light of recent food safety issues, the USDA has become more aggressive in its acceptance criteria and inspections of equipment used in the food, dairy and beverage industries. The USDA has promulgated standards related to the cleanliness and cleanability of equipment used in these industries. Due to these standards, it is becoming increasingly more important for food, dairy and beverage producers to have equipment that is USDA accepted to stay competitive in the marketplace.

Agitators, and more particularly horizontal agitators, for use in the food, dairy and beverage industries are known in the art. Conventional agitators generally include an impeller attached to a rotatable shaft that is supported by a body. The body is placed within the wall of a storage tank so that the impeller blades are positioned toward the interior of the tank. The end of the shaft that is outside the storage tank is generally attached to a motor or other means to cause rotation of the shaft.

Conventional agitator designs suffer from several limitations that render them difficult to achieve USDA acceptance. In one known agitator design, an owner is required to climb into the tank, manually remove the exposed parts and individually clean the parts by hand. In another known agitator design, cleaning fluid is forced through the body and exits the nose of the agitator at high pressure to clean the impeller blades. In this design an owner is required to loosen a shaft collar and push the shaft forward by hand to disengage a nose seal from the agitator body. The movement of the shaft enables cleaning fluid to flow through the interior of the body to effectively clean the body and adjacent sealing surfaces. After cleaning, the owner must manually pull the shaft back and retighten the collar before operation. Over-tightening the collar can result in damage to the nose seal and under-tightening allows leakage into the body during a mixing operation.

Those skilled in the art continue to attempt to improve upon the designs of current horizontal agitators, particularly to improve their cleanability for USDA acceptance. The present invention provides an effective USDA-accepted, mechanically cleaned-in-place (CIP) horizontal agitator.

SUMMARY OF THE INVENTION

The present invention recognizes the aforementioned limitations associated with conventional horizontal agitators and provides a USDA-accepted, mechanically cleaned-in-place horizontal agitator assembly.

In accordance with an embodiment of the present invention, a horizontal agitator assembly is provided that includes an impeller secured to a shaft that is rotatably supported within a body. A sealing member is positioned on the shaft between the impeller and a distal end of the body to prevent the ingress of matter into the body. The body of the agitator assembly is disposed within the wall of a storage tank and is secured to the storage tank by a mounting assembly. The body is preferably a one-piece design having internally smooth surfaces that are free from crevices that can facilitate collection of undesirable foreign matter, such as bacteria. The body includes a rear seal assembly having a connection member attached thereto to secure the agitator assembly to a cleaning fluid source. A bushing comprising a self-lubricating polymer is disposed near the distal end of the body to support the shaft. The bushing is provided with internal and external grooves that allow passage of the cleaning fluid to effectively clean the shaft and impeller.

The mounting assembly supports the weight of a motor assembly that supplies rotative power to the shaft. A shaft housing is rotatably supported within the motor assembly and provides a means to attach the shaft to the motor assembly. An area of the shaft that is positioned within the shaft housing contains a plurality of radially extending teeth that engage the shaft housing. The end of the shaft opposite the impeller includes a plurality of threads that engage the internal threads of a shaft collar that is positioned on the shaft. A compressible member is positioned on the shaft between the shaft housing and the shaft collar.

During a CIP cycle, cleaning fluid enters the port in the rear seal assembly and travels between the body and the shaft to effectively clean the internal surfaces of the agitator assembly. A portion of the cleaning fluid is forced through the internal grooves of the bushing to clean the area of the shaft in proximity with the bushing. The remainder of the cleaning fluid is forced through the external grooves until it reaches the sealing member. Upon reaching the sealing member, the fluid pressure increases until the pressure overcomes the biasing force of the compressible member and forces the sealing member and shaft to move axially away from the distal end of the body permitting the cleaning fluid to escape. The escaping fluid is redirected by the contoured geometry of the distal end of the body to provide pressurized mechanical cleaning of the impeller blades and adjacent sealing surfaces during the CIP cycle.

The foregoing agitator assembly design is USDA accepted and may be cleaned-in-place without the need to disassemble the agitator and clean it by hand. Moreover, the agitator assembly automates the cleaning cycle by eliminating the need to loosen the shaft collar and push the shaft forward by hand. Various additional aspects and advantages of this invention will become apparent to those skilled in the art from the following detailed description of the preferred embodiment, when read in light of the accompanying drawings.

BRIEF DESCRIPTION OF THE DRAWINGS

The features and inventive aspects of the present invention will become more apparent upon reading the following detailed description, claims, and drawings, of which the following is a brief description:

DESCRIPTION OF THE PREFERRED EMBODIMENT

Figure 1:
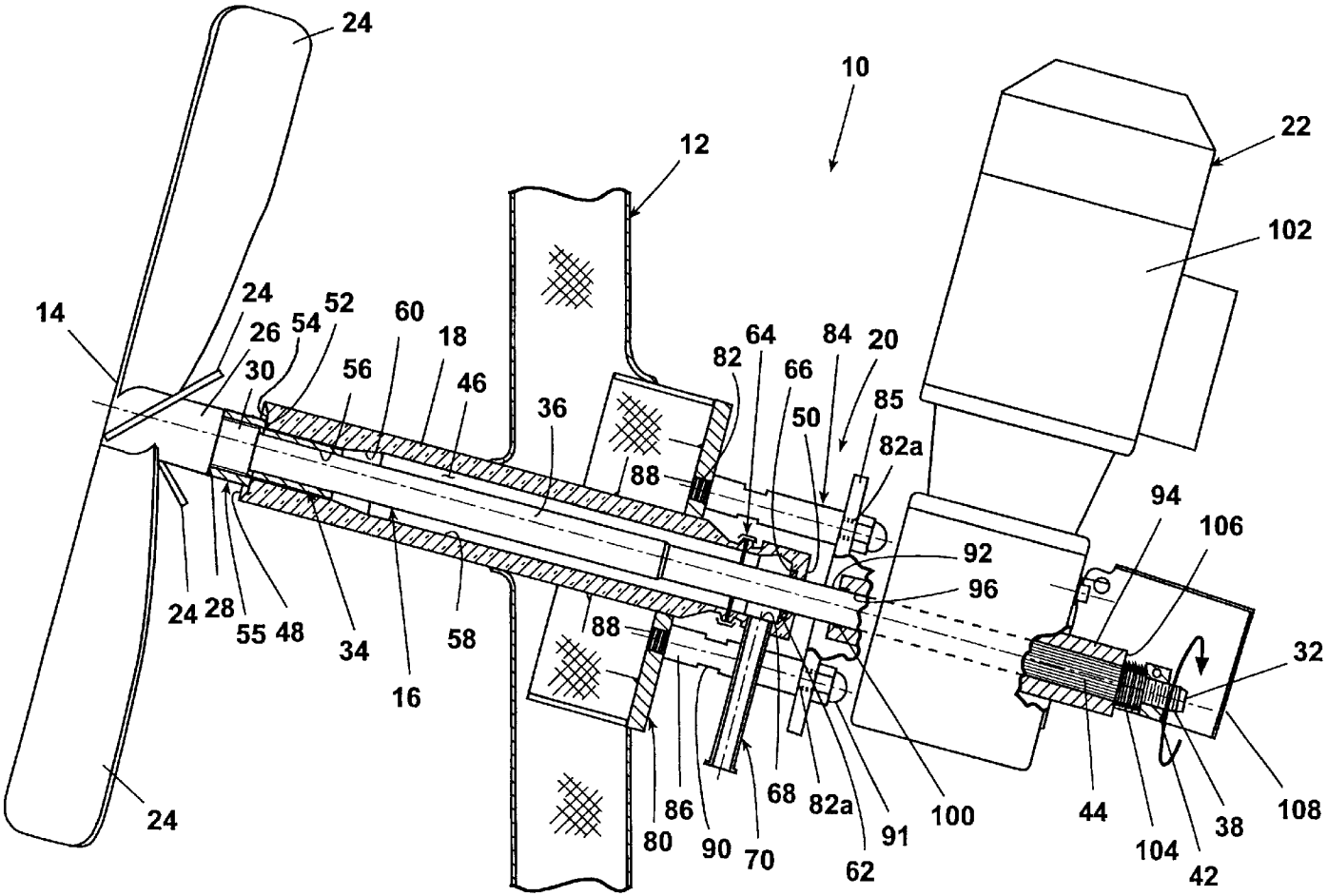
FIG. 1 is a partial sectional view of an embodiment of the present invention showing the agitator assembly secured in a storage tank.

Referring now to the drawings, the preferred embodiments of the present invention are described in detail.

Referring to FIG. 1, a preferred embodiment of an agitator assembly 10 is shown mounted in a storage tank 12. Agitator assembly 10 generally includes an impeller 14 secured to a shaft 16 that is rotatably supported in a body 18. Agitator assembly further includes a mounting assembly 20 for securing agitator assembly 10 in tank 12 and for supporting a motor assembly 22 that supplies power to rotate shaft 16.

Impeller 14 is preferably formed of a material suitable for use in the food, dairy or beverage industry, such as stainless steel or an FDA approved plastic. Impeller 14 generally includes a plurality of blades 24 that extend radially outwardly away from a hub 26. Hub 26 includes a receiving portion 28 that receives a distal end 30 of shaft 16. Impeller 14 is preferably welded to shaft 16, but may be secured by other means known in the art.

Shaft 16 is also preferably formed of a material suitable for use in the food, dairy or beverage industry, such as stainless steel or an FDA approved plastic. Shaft 16 extends from distal end 30 to an engagement end 32. Shaft 16 is rotatably supported within body 18 near distal end 30 by a bushing 34 and near engagement end 32 by motor assembly 22. In this configuration, shaft 16 is capable of rotative and axial movement within body 18. The portion of shaft 16 that is positioned within body 18 preferably includes a smooth surface 36 that is free of crevices. Engagement end 32 of shaft 16 preferably includes a plurality of threads 38 for engaging the corresponding internal threads (not illustrated) of a shaft collar 42. Additionally, shaft 16 preferably includes a plurality of radially extending teeth 44 that are positioned to engage motor assembly 22, as will be described in further detail below.

Body 18 is preferably a one-piece design formed of a strong material, such as stainless steel or an FDA approved high-strength plastic. Body 18 generally includes a duct 46 therethrough that extends from a duct distal end 48 to a rear seal assembly 50. Referring to FIG. 1A, duct distal end 48 of body 18 includes a generally recessed and preferably flat surface 52 extending radially outwardly from duct 46. Surface 52 terminates into a preferably contoured surface 54 that is designed to direct the flow of pressurized fluid, as will be described in further detail below. A sealing element 55, having a preferably polymeric composition, is provided over distal end 30 of shaft 16 and is biased on one end by hub 26. During a mixing operation, sealing element 55 sealingly engages flat surface 52 to prohibit the ingress of foreign matter into duct 46.

Duct 46 generally includes a first interior surface 56 and a second interior surface 58 having a diameter that is preferably greater than the diameter of the first interior surface 56. First and second interior surfaces 56 and 58 are preferably smooth and free from crevices to prevent the growth and accumulation of undesirable foreign matter, such as bacteria. First interior surface 56 extends from distal end 48 of body 18 to a preferably radially outwardly tapered surface 60. Second interior surface 58 extends from surface 60 to a counterbore 62 positioned in rear seal assembly 50. The diameter of second interior surface 58 is preferably sized to create an annular void between second interior surface 58 and shaft 16 to permit passage of cleaning fluid during a CIP operation, as will be described in detail below.

Rear seal assembly 50 is preferably secured to body 18 by a U-clamp 64. An annular sealing element 66, preferably having an elastomeric composition, is disposed within counterbore 62 to sealingly engage shaft 16. A port 68 is formed preferably perpendicular to duct 46 to allow passage of a fluid into body 18. A connecting member 70 is secured in port 68 to provide communication between a fluid source and duct 46.

Figure 2:
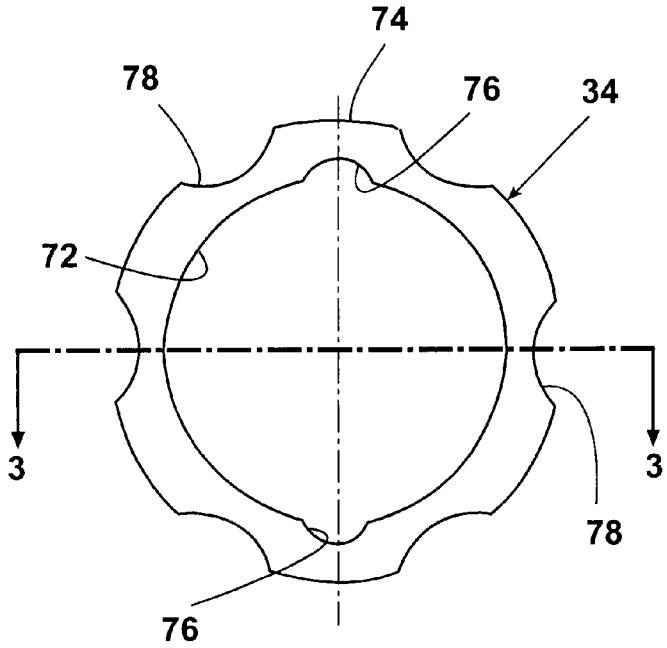
FIG. 2 is a front view of a bushing according to the present invention.
Figure 3:
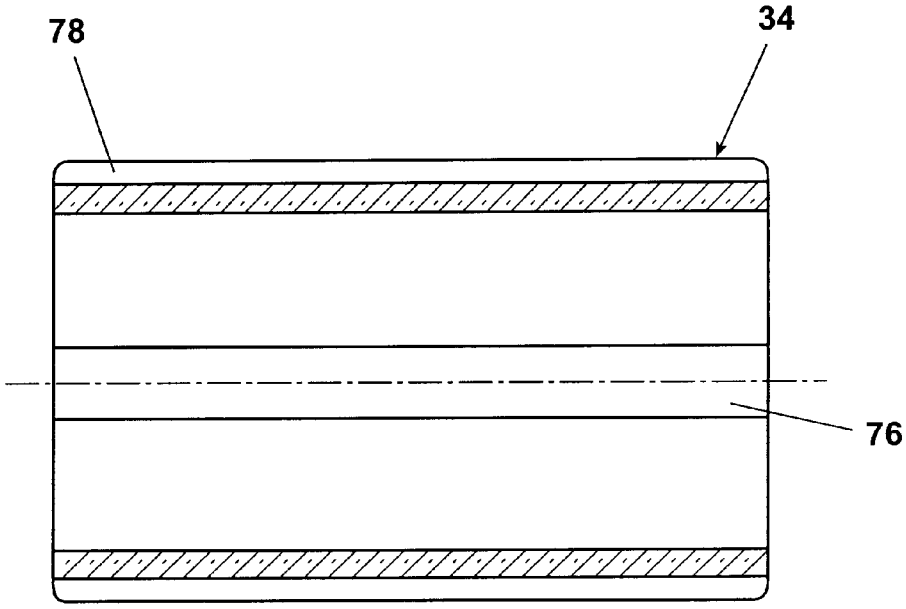
FIG. 3 is a cross-sectional view of the bushing shown in FIG. 2.

Bushing 34 is provided between shaft 16 and first interior surface 56 in body 18. Referring to FIGS. 2 and 3, bushing 34 is preferably formed of a polymeric material, such as an FDA approved polybutylene teraphalate polyester, and more preferably of an internally-lubricated polymeric material that exhibits a high wear resistance and a low coefficient of friction. In a preferred embodiment, bushing 34 has a generally cylindrical cross-section that includes an inner surface 72 and an outer surface 74. Inner surface 72 includes at least one, and preferably two, axial passageways 76. Outer surface 74 includes a plurality of preferably equidistantly spaced axial passageways 78. Passageways 76 permit fluid flow between shaft 16 and bushing 34 to clean shaft 16. Similarly, passageways 78 permit fluid flow between bushing 34 and first interior surface 56 of body 18 to clean impeller 14, interior surface 56 and bushing 34.

Referring to FIG. 1, in a preferred embodiment, mounting assembly 20 is positioned to attach agitator assembly 10 to storage tank 12 and to generally support the weight of the components of agitator assembly 10 positioned on the exterior of storage tank 12. Mounting assembly 20 preferably includes a first structural plate 80 secured to storage tank 12 at a predetermined angle. In a preferred embodiment, first structural plate 80 includes a plurality of threaded apertures 82 therethrough, each for receiving a fastener 84 such as a bolt. A second structural plate 85 is integrally formed with motor assembly 22 and includes a plurality of apertures **82*a* that correspond in position to apertures 82 in first structural plate 80. Fastener 84 generally includes a cylindrical body 86 having a threaded engagement portion 88 on each end. Fastener 84 preferably includes at least one flat 90 for engagement by a wrench to secure fastener 84 into first plate 80. Moreover, threaded engagement portion 88 is preferably longer on one end of fastener 84 such that, upon assembly of second plate 85, the threads are exposed on the opposite side of second plate 85. A nut 91, such as an acorn nut, threadably engages the exposed threads of the fastener 84 to secure second plate 85 to fasteners 84. An additional aperture 92 is provided in the center of the second plate 85 to allow passage of shaft 16. A shaft housing 94 is rotatably supported within motor assembly 22 and provides a means to attach shaft 16 to motor assembly 22. Shaft housing 94 includes a duct 96 therethrough for receiving shaft 16. Duct 96 includes an inwardly facing groove having disposed therein an annular sealing element 100, such as an o-ring, to prevent the ingress of contamination into duct 96. Radially extending teeth 44 on shaft 16 engage the interior surface of duct 96 to permit only axial movement of shaft 16 in shaft housing 94**.

Motor assembly 22 is provided to supply power for rotation of shaft 16 and impeller 14. In a preferred embodiment, motor assembly 22 includes a motor 102, such as an electric motor, in communication with shaft housing 94. Motor 102 may be attached to a transmission or placed directly in communication with shaft housing 94. Preferably, motor 102 is positioned perpendicular to shaft housing 94 to permit the use of a helical gear between the motor shaft and shaft housing 94. In this configuration, a helical gear is the preferred power transmission device given its ability to transmit motion and power between shafts that are positioned perpendicular to each other.

Figure 1B:
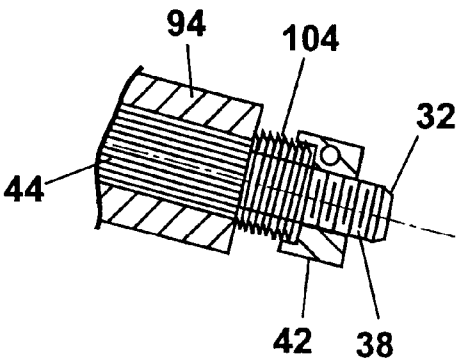
FIG. 1B is an enlarged view of an engagement end of the agitator assembly of FIG. 1.
Figure 1A:
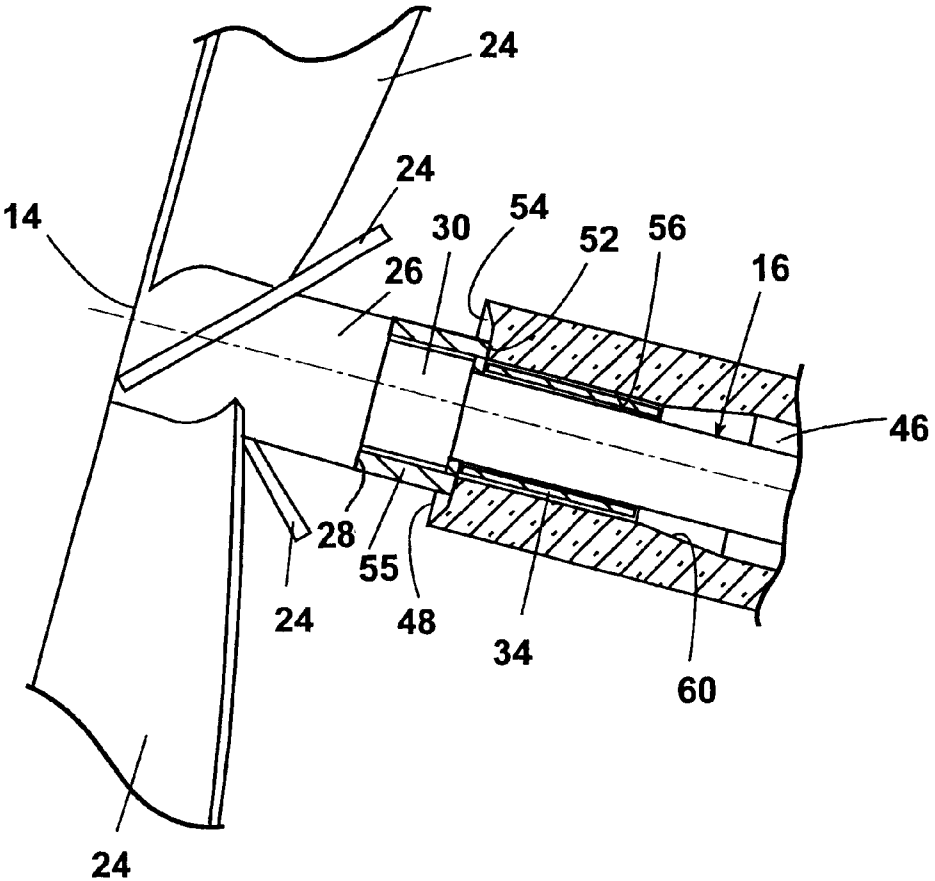
FIG. 1A is an enlarged view of a duct distal end of the agitator assembly of FIG. 1.

As illustrated in FIGS. 1 and 1B, a resilient member 104, such as a spring, is preferably positioned between shaft collar 42 and a terminal end 106 of shaft housing 94. A hinged guard assembly 108 is provided over terminal end 106 of shaft housing 94, resilient member 104 and shaft collar 42 to enclose the exposed components. Resilient member 104 acts against shaft collar 42 which in turn forces shaft 16 in an axial direction that allows sealing element 55 to sealingly engage distal end 48 of body 18. The sealing pressure of sealing element 55 against body 18 can be increased by rotating shaft collar 42 in a clockwise direction such that shaft collar 42 further compresses resilient member 104. As resilient member 104 is compressed, the biasing force against shaft collar 42 and shaft 16 is increased resulting in an increase in the sealing pressure between sealing element 55 and body 18 and hub 26.

The cleaning operation of the inventive agitator assembly 10 will be described with reference now to FIGS. 1, 2 and 3. When it is desired to clean agitator assembly 10, the user attaches a source of cleaning fluid by connecting a supply hose having a USDA-accepted terminal connector to connection member 70. While the shaft is rotating, the cleaning fluid enters body 18 at port 68 where it is directed axially along shaft 16 through duct 46. The smooth surfaces of shaft 16 and duct 46 permit the fluid to easily pick up any foreign matter within duct 46. As the fluid is directed past surface 60, the fluid velocity increases as it is forced into the area of body 18 occupied by bushing 34. A portion of the fluid passes through grooves 76 on inner surface 72 of bushing 34 and a greater portion of the fluid passes through grooves 78 on outer surface 74. The portion of the fluid that passes through grooves 76 serves to clean the portion of shaft 16 adjacent bushing 34 as it rotates. The greater portion of fluid that passes through grooves 78 acts against distal end 30 of shaft 16 and sealing member 55. The fluid pressure against distal end 30 and sealing member 55 accumulates until the pressure overcomes the biasing force of resilient member 104 and forces distal end 30 of shaft 16 and impeller 14 axially away from body 18. Upon movement of shaft 16 away from body 18, the high-pressure fluid exits body 18 and is redirected by the contoured distal end 48 of body 18 to clean impeller blades 24. Contoured surface 54 is preferably divided into four quadrants with at least one of the quadrants having a different radius than the other quadrants. The various radii of contoured surface 54 permit the fluid to be redirected to different areas of blades 24 as impeller 14 rotates.

Generally, a minimum fluid supply pressure of approximately 20 psi (1.4 bar) is all that is need to effectively clean agitator assembly 10 during the cleaning operation. However, the fluid supply pressure required to effect axial movement of shaft 16 can be varied by adjusting the position of shaft collar 42 or by varying the input fluid pressure. For example, to reduce the pressure required to move shaft 16, shaft collar 42 may be rotated in a counterclockwise direction to decrease the compression of resilient member 104. Alternatively, in order to increase the fluid pressure exiting the body at contoured distal end 48, shaft collar 42 may be turned in a clockwise direction to increase the biasing force of resilient member 104. The corresponding fluid pressure needed to overcome the increased biasing force of resilient member 104 will result in a greater fluid exit velocity at the contoured distal end 48 of body 18. After completion of the CIP cycle, the supply hose is removed and the agitator is automatically placed back into operation.

Accordingly, the present invention provides a USDA accepted horizontal agitator assembly that automates cleaning by supplying pressurized cleaning fluid to the body, impeller blades and adjacent sealing surfaces during a CIP cycle. The design avoids the need to climb into the tank, manually disassemble the assembly, and clean the disassembled parts by hand.

Although certain preferred embodiments of the present invention have been described, the invention is not limited to the illustrations described and shown herein, which are deemed to be merely illustrative of the best modes of carrying out the invention. A person of ordinary skill in the art will realize that certain modifications and variations will come within the teachings of this invention and that such variations and modifications are within its spirit and the scope as defined by the claims.

What is claimed is:

1. An agitator assembly for mounting in a wall of a storage tank, said agitator assembly comprising:

a body member extending through said wall of said storage tank, said body member including a seal assembly that is in communication with a fluid source;

a rotatable shaft extending longitudinally through said body member, said shaft extending from a distal end to an engagement end and having a substantially smooth inner surface adjacent said distal end;

an impeller secured to said distal end of said shaft;

a collar positioned on said engagement end of said shaft;

an input device in communication with said shaft for supplying power to rotate said shaft; and a resilient member positioned over said shaft between said input device and said collar;

whereby when a fluid is injected into said body, the fluid pressure increases until the pressure overcomes the biasing force of said resilient member and causes said shaft to move in an axial direction permitting the fluid to escape the body under pressure to effectively clean the impeller.

2. The assembly of claim 1, wherein said body includes a duct having a diameter that is larger than the diameter of said shaft to allow passage of said fluid between said duct and said shaft.

3. The assembly of claim 1, wherein said body includes a contoured portion for directing the pressurized fluid flow onto said impeller.

4. The assembly of claim 3, wherein said contoured portion includes four quadrants with at least one quadrant having a different radius than the remaining quadrants.

5. The assembly of claim 3, wherein a sealing element is positioned on said shaft to sealingly engage said contoured portion to prohibit the ingress of foreign matter into said body.

6. The assembly of claim 1, further including a bushing disposed between said shaft and said body.

7. The assembly of claim 6, wherein said bushing includes an inner surface having a least one groove and an outer surface having a plurality of grooves.

8. The assembly of claim 7, wherein said bushing comprises a self-lubricating polymeric material exhibiting a high wear resistance and low coefficient of friction.

9. The assembly of claim 1, wherein said impeller includes a plurality of blades that extend radially outwardly from a hub.

10. The assembly of claim 1, further including a mounting assembly for securing said agitator assembly to said storage tank.

11. The assembly of claim 1, wherein said input device is a motor assembly.

12. The assembly of claim 11, wherein said motor assembly includes an electric motor attached to a gear arrangement that is in communication with a shaft housing having a duct for receiving said shaft.

13. An agitator assembly for mounting in a wall of a storage tank, said agitator assembly comprising:

a body member extending through said wall of said storage tank, said body member including a contoured portion and a seal assembly that is in communication with a fluid source;

a rotatable shaft extending longitudinally through said body member, said shaft extending from a distal end to an engagement end;

a bushing disposed between said shaft and said body, said bushing including an inner surface having a least one groove and an outer surface having a plurality of grooves;

an impeller secured to said distal end of said shaft;

a sealing element positioned on said shaft to sealingly engage said contoured portion to prohibit the ingress of foreign matter into said body;

an input device in communication with said shaft for supplying power to rotate said shaft;

a collar positioned on said engagement end of said shaft; and a resilient member positioned over said shaft between said input device and said collar;

whereby when a fluid is injected into said body, the fluid pressure increases until the pressure overcomes the biasing force of said resilient member and causes said shaft to move in an axial direction permitting the fluid to escape the body between said sealing element and said contoured portion to effectively clean the impeller.

14. The assembly of claim 13, wherein said body includes a duct having a diameter that is larger than the diameter of said shaft to allow passage of a fluid between said duct and said shaft.

15. The assembly of claim 13, wherein said contoured portion includes four quadrants with at least one quadrant having a different radius than the remaining quadrants.

16. The assembly of claim 13, wherein said bushing comprises a self-lubricating polymeric material exhibiting a high wear resistance and low coefficient of friction.

17. The assembly of claim 13, wherein said impeller includes a plurality of blades that extend radially outwardly from a hub.

18. The assembly of claim 13, further including a mounting assembly for securing said agitator assembly to said storage tank.

19. The assembly of claim 13, wherein said input device is a motor assembly.

20. An agitator assembly for mounting in a wall of a storage tank, said agitator assembly comprising:

a body member extending through said wall of said storage tank, said body member including a seal assembly that is in communication with a fluid source;

a rotatable shaft extending longitudinally through said body member, said shaft extending from a distal end to an engagement end and having a substantially smooth surface adjacent said distal end;

an impeller secured to said distal end of said shaft;

a sealing element positioned on said shaft;

an input device in communication with said shaft for supplying power to rotate said shaft; and a means for biasing said sealing element against said body member, wherein said means for biasing is positioned over said shaft and outside said body member.

21. An agitator assembly for mounting in a wall of a storage tank, said agitator assembly comprising:

a body member extending through said wall of said storage tank, said body member including a seal assembly that is in communication with a fluid source, and a contoured portion for directing the pressurized fluid flow onto said impeller, said contoured portion including four quadrants with at least one quadrant having a different radius than the remaining quadrants;

a rotatable shaft extending longitudinally through said body member, said shaft extending from a distal end to an engagement end;

an impeller secured to said distal end of said shaft;

a collar positioned on said engagement end of said shaft;

an input device in communication with said shaft for supplying power to rotate said shaft; and a resilient member positioned over said shaft between said input device and said collar;

whereby when a fluid is injected into said body, the fluid pressure increases until the pressure overcomes the biasing force of said resilient member and causes said shaft to move in an axial direction permitting the fluid to escape the body under pressure to effectively clean the impeller.

22. An agitator assembly for mounting in a wall of a storage tank, said agitator assembly comprising:

a body member extending through said wall of said storage tank, said body member including a seal assembly that is in communication with a fluid source;

a rotatable shaft extending longitudinally through said body member, said shaft extending from a distal end to an engagement end;

a bushing disposed between said shaft and said body, wherein said bushing includes an inner surface having at least one groove and an outer surface having a plurality of grooves;

an impeller secured to said distal end of said shaft;

a collar positioned on said engagement end of said shaft;

an input device in communication with said shaft for supplying power to rotate said shaft; and a resilient member positioned over said shaft between said input device and said collar;

whereby when a fluid is injected into said body, the fluid pressure increases until the pressure overcomes the biasing force of said resilient member and causes said shaft to move in an axial direction permitting the fluid to escape the body under pressure to effectively clean the impeller.

23. The assembly of claim 22, wherein said bushing comprises a self-lubricating polymeric material exhibiting a high wear resistance and low coefficient of friction.

* * * * *